US009475113B2

(12) United States Patent
Naitou et al.

(10) Patent No.: US 9,475,113 B2
(45) Date of Patent: Oct. 25, 2016

(54) PROCESS FOR PRODUCING HOT PRESS-FORMED PRODUCT

(75) Inventors: Junya Naitou, Kobe (JP); Toshio Murakami, Kobe (JP); Shushi Ikeda, Nagoya (JP); Keisuke Okita, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 393 days.

(21) Appl. No.: 14/113,534

(22) PCT Filed: Apr. 27, 2012

(86) PCT No.: PCT/JP2012/061473

§ 371 (c)(1),
(2), (4) Date: Oct. 23, 2013

(87) PCT Pub. No.: WO2012/147963

PCT Pub. Date: Nov. 1, 2012

(65) Prior Publication Data

US 2014/0044585 A1 Feb. 13, 2014

(30) Foreign Application Priority Data

Apr. 28, 2011 (JP) ..... 2011-102408

(51) Int. Cl.

| | |
|---|---|
| ***C22C 38/02*** | (2006.01) |
| ***C21D 8/04*** | (2006.01) |
| ***B21D 22/00*** | (2006.01) |
| ***B21D 31/00*** | (2006.01) |

(Continued)

(52) U.S. Cl.

CPC ..... *B21D 22/208* (2013.01); *C21D 1/673* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C23C 2/02* (2013.01); *C23C 2/06* (2013.01); *C23C 2/28* (2013.01); *C23C 2/40* (2013.01); *C21D 2211/001* (2013.01); *C21D 2211/002* (2013.01); *C21D 2211/008* (2013.01)

(58) Field of Classification Search

None

See application file for complete search history.

(56) References Cited

U.S. PATENT DOCUMENTS

2008/0286603 A1 11/2008 Oh et al.
2008/0308194 A1 12/2008 Corquillet et al.

(Continued)

FOREIGN PATENT DOCUMENTS

CN 101275200 A 10/2008
CN 101316942 A 12/2008

(Continued)

OTHER PUBLICATIONS

Machine-English translation of Japanese patent publication No. 2006-070346, Hayashi Kunio et al., Mar. 16, 2006.*

(Continued)

*Primary Examiner* — Deborah Yee

(74) *Attorney, Agent, or Firm* — Studebaker & Brackett PC

(57) ABSTRACT

There is provided a hot press-formed product, including a thin steel sheet formed by a hot press-forming method, and having a metallic structure that contains retained austenite at 3% to 20% by volume, whereby balance between strength and elongation can be controlled in a proper range and high ductility can be achieved.

4 Claims, 1 Drawing Sheet

(51) Int. Cl.

| | |
|---|---|
| ***B21D 22/20*** | (2006.01) |
| ***C21D 1/673*** | (2006.01) |
| ***C22C 38/00*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/28*** | (2006.01) |
| ***C22C 38/32*** | (2006.01) |
| ***C22C 38/08*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(56) References Cited

U.S. PATENT DOCUMENTS

| | | | |
|---|---|---|---|
| 2011/0249995 | A1 | 10/2011 | Uchida et al. |
| 2012/0211128 | A1 | 8/2012 | Corquillet et al. |
| 2013/0048161 | A1 | 2/2013 | Matsuda et al. |

FOREIGN PATENT DOCUMENTS

| | | | |
|---|---|---|---|
| JP | 2006070346 | A | 3/2006 |
| JP | 2007-016296 | A | 1/2007 |
| JP | 2009-030159 | A | 2/2009 |
| JP | 2009-508692 | A | 3/2009 |
| JP | 2010-174280 | A | 8/2010 |
| JP | 2010174281 | A | 8/2010 |
| JP | 2011184758 | A | 9/2011 |
| JP | 2012041613 | A | 3/2012 |
| KR | 10-0711445 | B1 | 4/2007 |

OTHER PUBLICATIONS

K. Lamprecht et al., "Thermo-Mechanical Properties of Tailor Welded Blanks in Hot Sheet Metal Forming Processes", Proc. IDDRG2010, 2010, pp. 1-12,Germany.

Usibor1500P(22MnB5)/1500MPa-8%-Ductibor500/500-700MPa-17% [searched on Apr. 27, 2013] Internet <http://www.arcelormittal.com/tailoredblanks/pre/seifware.pl>, 4 pages.

B. Casas et al., "Tailor made tool materials for the present and upcoming tooling solutions in hot sheet metal forming", Proc. of 1st Int. Conf. on Hot Sheet Metal Forming of High-Performance steel, pp. 23-35, 2008.

R. Erhardt et al., "Industrial application of hot forming process simulation", Proc. of 1st Int. Conf. on Hot Sheet Metal Forming of High-Performance steel, pp. 83-88, 2008.

International Search Report from ISA/Japanese Patent Office in a corresponding International Application No. PCT/JP2012/061473 dated Jul. 31, 2012, 2 page in Japanese and 2 page of translation in English.

The International Preliminary Report on Patentability and Written Opinion of the International Searching Authority from the International Bureau of WIPO in a corresponding International Application No. PCT/JP2012/061473 dated Oct. 29, 2013, 4 pages in Japanese and 7 page in English.

* cited by examiner

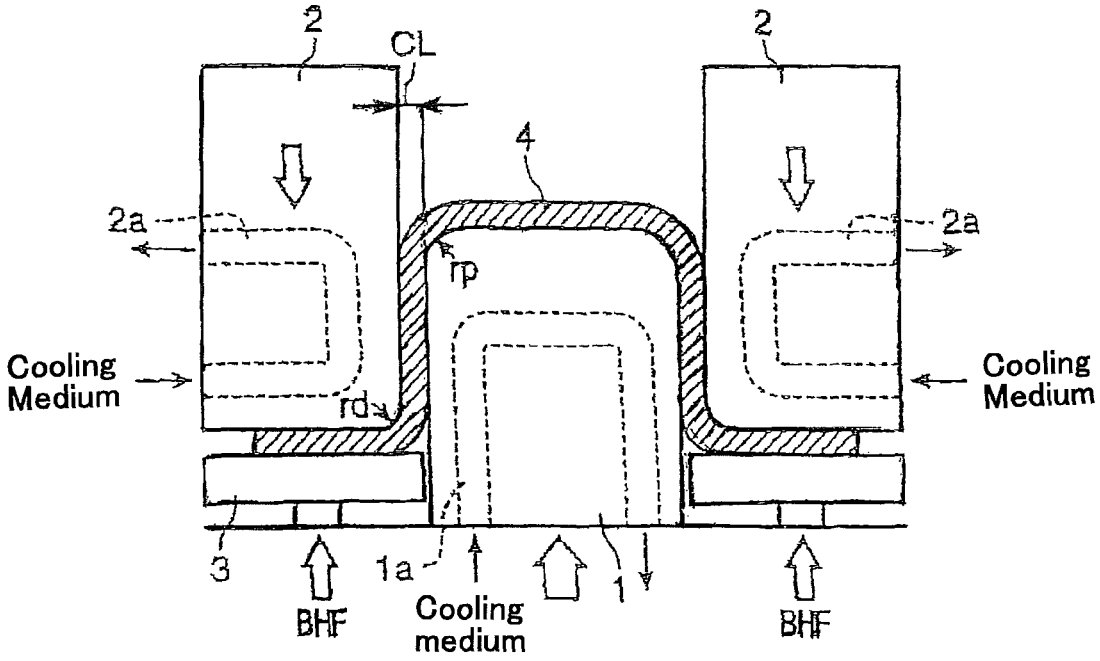
2
CL
2
4
2a
2a
rp
Cooling
Medium
Cooling
Medium
rd
3
1a
1
BHF
Cooling
medium
BHF

PROCESS FOR PRODUCING HOT PRESS-FORMED PRODUCT

TECHNICAL FIELD

The present invention relates to a hot press-formed product required to have high strength, such as used for structural members of automobile parts, a process for producing the same, and a thin steel sheet for hot press forming. In particular, the present invention relates to a hot press-formed product that can be provided with a prescribed shape and at the same time heat treated to have prescribed strength when a preheated steel sheet (blank) is formed into the prescribed shape, a process for producing such a hot press-formed product, and a thin steel sheet for hot press forming.

BACKGROUND ART

As one of the measures for fuel economy improvement of automobiles beginning from global environmental problems, automobile body lightening has proceeded, and steel sheets to be used for automobiles need to be strengthened as highly as possible. However, highly strengthening of steel sheets for automobile lightening lowers elongation EL or r value (Lankford value), resulting in the deterioration of press formability or shape fixability.

To solve such a problem, a hot press-forming method has been adopted for production of parts, in which method a steel sheet is heated to a prescribed temperature (e.g., a temperature for change in austenite phase) to lower its strength (i.e., make it easily formable) and then formed with a press tool at a temperature (e.g., room temperature) lower than that of the thin steel sheet, whereby the steel sheet is provided with a shape and at the same time heat treated by rapid cooling (quenching), which makes use of a temperature difference between both, to secure its strength after forming.

According to such a hot pressing method, a steel sheet is formed in a state of low strength, and therefore, the steel sheet has decreased springback (favorable shape fixability). In addition, the use of a material having excellent hardenability, to which alloy elements such as Mn and B have been added, thereby obtaining a strength of 1500 MPa class in terms of tensile strength by rapid cooling. Such a hot press-forming method has been called with various names, in addition to a hot press method, such as a hot forming method, a hot stamping method, a hot stamp method, and a die quench method.

FIG. 1 is a schematic explanatory view showing the structure of a press tool for carrying out hot press forming as described above (hereinafter represented sometimes by "hot stamp"). In this figure, reference numerals 1, 2, 3, and 4 represent a punch, a die, a blank holder, and a steel sheet (blank), respectively, and abbreviations BHF, rp, rd, and CL represent a blank holding force, a punch shoulder radius, a die shoulder radius, and a clearance between the punch and the die, respectively. In these parts, punch 1 and the 2 have passage 1*a* and passage 2*a*, respectively, formed in the inside thereof, through which passages a cooling medium (e.g., water) can be allowed to pass, and the press tool is made to have a structure so that these members can be cooled by allowing the cooling medium to pass through these passages.

When a steel sheet is subjected to hot stamp (e.g., hot deep drawing) with such a press tool, the forming is started in a state where steel sheet (blank) 4 is softened by heating to a temperature within two-phase region, which is from $Ac_1$ transformation point to $Ac_3$ transformation point, or a temperature within single-phase region, which is not lower than $Ac_3$ transformation point. More specifically, steel sheet 4 is pushed into a cavity of die 2 (between the parts indicated by reference numerals 2 and 2 in FIG. 1) by punch 1 with steel sheet 4 in high-temperature state being sandwiched between die 2 and blank holder 3, thereby forming steel sheet 4 into a shape corresponding to the outer shape of punch 1 while reducing the outer diameter of steel sheet 4. In addition, heat is removed from steel sheet 4 to the press tool (punch 1 and die 2) by cooling punch and die in parallel with the forming, and the hardening of the material is carried out by further retaining and cooling steel sheet 4 at the lower dead point in the forming (the point of time when the punch head is positioned at the deepest level: the state shown in FIG. 1). Formed products with high dimension accuracy and strength of 1500 MPa class can be obtained by carrying out such a forming method. Furthermore, such a forming method results in that the volume of a pressing machine can be made smaller because a forming load can be reduced as compared with the case where parts of the same strength class are formed by cold pressing.

As steel sheets for hot stamp, which have widely been used at present, there are known steel sheets based on 22MnB5 steel. These steel sheets have tensile strengths of 1500 MPa and elongations of about 6% to 8%, and have been applied to impact-resistant members (members neither deformed nor fractured as much as possible at the time of impact). In addition, some developments have also proceeded for C content increase and further highly strengthening (in 1500 to 1800 MPa class) based on 22MnB5 steel.

However, there is almost no application of steel grades other than 22MnB5 steel. One can find a present situation where little consideration is made on steel grades or methods for controlling the strength and elongation of parts (e.g., strength lowering to 980 MPa class and elongation enhancement to 20%) to extend their application range to other than impact-resistant members.

In middle or higher class automobiles, taking into consideration compatibility (function of, when a small class automobile comes to collide, making safe of the other side) at the time of side or back impact, both functions as an impact-resistant portion and an energy-absorbing portion may sometimes be provided in parts such as B pillars or rear side members. To produce such members, there has mainly been used so far, for example, a method in which ultra-high tensile strength steel sheets having high strength of 980 MPa class and high tensile strength steel sheets having elongation of 440 MPa class are laser welded (to prepare a tailor welded blank, abbreviated as TWB) and then cold press formed. However, in recent years, the development of a technique has proceeded, in which parts are each provided with different strengths by hot stamp.

For example, Non-patent Document 1 has proposed a method of laser welding 22MnB5 steel for hot stamp and a material that does not have high strength even if quenched with a press tool (to prepare a tailor welded blank, abbreviated as TWB), followed by hot stamp, in which method different strengths are provided so that tensile strength at a high strength side (i.e., impact-resistant portion side) becomes 1500 MPa (and elongation becomes 6% to 8%) and tensile strength at a low strength side (i.e., energy-absorbing portion side) becomes 440 MPa (and elongation becomes 12%). In addition, as the technique of providing parts each with different strengths, some techniques have also been proposed, such as disclosed in Non-patent Documents 2 to 4.

The techniques disclosed in Non-patent Documents 1 and 2 provide a tensile strength of not higher than 600 MPa and an elongation of about 12% to 18% at an energy-absorbing portion side, in which techniques, however, laser welding (to prepare a tailor welded blank, abbreviated as TWB) is needed previously, thereby increasing the number of steps and resulting in high cost. In addition, it results in the heating of energy-absorbing portions, which need not to be hardened originally. Therefore, these techniques are not preferred from the viewpoint of energy consumption.

The technique disclosed in Non-patent Document 3 is based on 22MnB5 steel, in which boron addition, however, adversely affects the robustness of strength after quenching against heating to a temperature within two-phase region, making difficult the control of strength at an energy-absorbing portion side, and further making it possible to obtain only an elongation as low as 15%.

The technique disclosed in Non-patent Document 4 is based on 22MnB5 steel, and therefore, this technique is not economic in that control is made in such a manner that 22MnB5, which originally has excellent hardenability, is not hardened (control of press tool cooling).

PRIOR ART DOCUMENTS

Non-Patent Documents

Non-patent Document 1: Klaus Lamprecht, Gunter Deinzer, Anton Stich, Jurgen Lechler, Thomas Stohr, Marion Merklein, "Thermo-Mechanical Properties of Tailor Welded Blanks in Hot Sheet Metal Forming Processes", Proc. IDDRG2010, 2010.

Non-patent Document 2: Usibor1500P(22MnB5)/1500 MPa-8%-Ductibor500/550-700 MPa-17% [searched on Apr. 27, 2011] Internet <http://www.arcelormittal.com/tailoredblanks/pre/seifware.pl>

Non-patent Document 3: 22MnB5/above AC3/1500 MPa-8%-below AC3/Hv190-Ferrite/Cementite Rudiger Erhardt and Johannes Boke, "Industrial application of hot forming process simulation", Proc, of 1st Int. Conf. on Hot Sheet Metal Forming of High-Performance steel, ed. By Steinhoff, K., Oldenburg, M, Steinhoff, and Prakash, B., pp 83-88, 2008.

Non-patent Document 4: Begona Casas, David Latre, Noemi Rodriguez, and Isaac Valls, "Tailor made tool materials for the present and upcoming tooling solutions in hot sheet metal forming", Proc, of 1st Int. Conf. on Hot Sheet Metal Forming of High-Performance steel, ed. By Steinhoff, K., Oldenburg, M, Steinhoff, and Prakash, B., pp 23-35, 2008.

SUMMARY OF THE INVENTION

Problems to be Solved by the Invention

The present invention has been made in view of the above-described circumstances, and its object is to provide a hot press-formed product in which balance between strength and elongation can be controlled in a proper range and high ductility can be achieved, a process useful for producing such a hot press-formed product, and a thin steel sheet for hot press forming.

Means for Solving the Problems

The hot press-formed product of the present invention, which can achieve the above object, is a hot press-formed product, characterized by comprising a thin steel sheet formed by a hot press-forming method, and having a metallic structure that contains retained austenite at 3% to 20% by volume. In the hot press-formed product of the present invention, the metallic structure may preferably contain, in addition to the retained austenite, annealed martensite or annealed bainite at 30% to 97% by volume, and as-quenched martensite at 0% to 67% by volume.

In the hot press-formed product of the present invention, the chemical element composition thereof is not particularly limited, typical examples of which may include the following chemical element composition: C at 0.1% to 0.3% (where "%" means "% by mass", and the same applies to the below with respect to the chemical element composition); Si at 0.5% to 3%; Mn at 0.5% to 2%; P at 0.05% or lower (not including 0%); S at 0.05% or lower (not including 0%); Al at 0.01% to 0.1%; and N at 0.001% to 0.01%, and the remainder consisting of iron and unavoidable impurities.

In the hot press-formed product of the present invention, it is also useful to allow additional elements to be contained, when needed; for example, (a) B at 0.01% or lower (not including 0%) and Ti at 0.1% or lower (not including 0%); (b) one or more selected from the group consisting of Cu, Ni, Cr, and Mo at 1% or lower (not including 0%) in total; and (c) V and/or Nb at 0.1% or lower (not including 0%) in total. Depending on the kind of element to be contained, the hot press-formed product may have further improved characteristics.

When the hot press-formed product of the present invention is produced, the following steps may be used, i.e., heating a thin steel sheet having a metallic structure that contains martensite or bainite at 80% by volume or higher to a temperature not lower than $Ac_1$ transformation point and not higher than ($Ac_1$ transformation point×0.2+$Ac_3$ transformation point×0.8); and then starting the forming of the thin steel sheet with a press tool to produce the hot press-formed product, during which forming an average cooling rate of 20° C./sec or higher is kept in the press tool.

The present invention further includes a thin steel sheet for hot press forming, which is intended for producing a hot press-formed product as described above, and this thin steel sheet is characterized by having a metallic structure that contains martensite or bainite at 80% by volume or higher.

Effects of the Invention

The present invention makes it possible that: retained austenite can be allowed to exist at a proper fraction in the metallic structure of a hot press-formed product by properly controlling the conditions of a hot press-forming method; a hot press-formed product having more enhanced ductility (retained ductility) inherent to the formed product as compared with the case where conventional 22MnB5 steel is used; and strength and elongation can be controlled by a combination of heat treatment conditions and pre-forming steel sheet structure (initial structure). In addition, the control of heating temperature within two-phase region makes it possible to provide different strengths and elongations freely.

BRIEF DESCRIPTION OF THE DRAWINGS

FIG. 1 is a schematic explanatory view showing the structure of a press tool for carrying out hot press forming.

MODE FOR CARRYING OUT THE INVENTION

The present inventors have studied from various angles to realize a hot press-formed product having high strength and further exhibiting excellent ductility (elongation) after forming when a thin steel sheet is heated to a prescribed temperature and then hot press formed to produce the formed product.

As a result, the present inventors have found that formed product structure having excellent balance between strength and ductility can be achieved when a thin steel sheet having a metallic structure that contains martensite or bainite at a prescribed fraction is used in the production of a hot press-formed product, and heating temperature and forming conditions are properly controlled so that retained austenite is contained at 3% to 20% by volume in the press forming with a press tool, thereby completing the present invention.

The reasons for setting the ranges of the respective structures (basic structure and preferred structures) in the hot press-formed product of the present invention are as follows:

[Retained Austenite at 3% to 20% by Volume]

Retained austenite is transformed into martensite during plastic deformation, thereby having the effect of increasing work hardening rate (transformation-inducing plasticity) to improve the ductility of a formed product. To make such an effect exhibited, the fraction of retained austenite should be controlled to 3% by volume or higher. When the fraction of retained austenite is higher, ductility becomes more excellent. In a composition to be used for automobile steel sheets, retained austenite that can be secured is limited, of which upper limit becomes about 20% by volume. The fraction of retained austenite may preferably be not lower than 5% by volume as the preferred lower limit (more preferably not lower than 7% by volume) and not higher than 15% by volume as the preferred upper limit (more preferably not higher than 10% by volume).

[Annealed Martensite or Annealed Bainite at 30% to 97% by Volume]

When a hot press-formed product is allowed to have a metallic structure composed mainly of annealed martensite or annealed bainite, which are fine and have low dislocation density, the hot press-formed product can have enhanced ductility (elongation), while securing prescribed strength. From this viewpoint, the volume fraction of annealed martensite or annealed bainite may preferably be controlled to 30% by volume or higher. However, when this fraction is higher than 97% by volume, the faction of retained austenite becomes insufficient, resulting in the lowering of ductility (retained ductility). The fraction of annealed martensite or annealed bainite may more preferably be not lower than 40% by volume as the more preferred lower limit (still more preferably not lower than 50% by volume) and lower than 90% by volume as the more preferred upper limit (still more preferably lower than 80% by volume).

[As-Quenched Martensite at 0% to 67% by Volume]

As-quenched martensite is a structure having poor ductility, and therefore, when as-quenched martensite exists in a high fraction, strength becomes too high, resulting in the deterioration of elongation. Therefore, the fraction of as-quenched martensite may be 0% by volume. However, as-quenched martensite is a structure extremely effective for strength enhancement, and therefore, the existence of as-quenched martensite in a proper fraction may be acceptable. From this viewpoint, the fraction of as-quenched martensite may preferably be controlled to 67% by volume or lower. The fraction of as-quenched martensite may more preferably be not higher than 60% by volume as the more preferred upper limit (still more preferably not higher than 50% by volume).

Besides the above structures, the metallic structure of a hot press-formed product may contain ferrite, pearlite, and/or bainite as the remainder structure, but may preferably not contain the remainder structure in a fundamental way because of lower contributions to strength and ductility as compared with the other structures (the fraction of the remainder structure may be even 0% by volume). However, the fraction of the remainder structure up to 20% by volume may be acceptable. The fraction of the remainder structure may more preferably be not higher than 10% by volume, still more preferably not higher than 5% by volume.

When the hot press-formed product of the present invention is produced, a thin steel sheet may be used, which has a metallic structure that contains martensite or bainite at 80% by volume or higher (and which has the same chemical element composition as that of the hot press-formed product), and when the thin steel sheet is press formed with a press tool, the thin steel sheet may be heated to a temperature not lower than $Ac_1$ transformation point and not higher than ($Ac_1$ transformation point×0.2+$Ac_3$ transformation point×0.8), and then the forming of the thin steel sheet may be started, during which forming an average cooling rate of 20° C./sec or higher may be kept in the press tool. The reasons for defining the respective requirements in this process are as follows:

[Thin Steel Sheet Having a Metallic Structure that Contains Martensite or Bainite at 80% by Volume or Higher]

To secure a proper fraction of annealed martensite or annealed bainite, which are fine and make high contributions to ductility, in the subsequent heating step (heating, hot press forming, and cooling), a thin steel sheet may preferably be used, which has a martensite or bainite fraction of 80% by volume or higher (i.e., the thin steel sheet for hot press forming of the present invention). When the fraction of martensite or bainite becomes lower than 80% by volume, neither annealed martensite nor annealed bainite can be secured in a proper fraction in the structure of a formed product, and furthermore, the other structure (e.g., ferrite) may have an enhanced fraction, resulting in the lowering of balance between strength and ductility. The fraction of martensite or bainite may more preferably be not lower than 90% by volume as the more preferred lower limit (still more preferably not lower than 95% by volume).

[Heating a Thin Steel Sheet to a Temperature not Lower than $Ac_1$ Transformation Point and not Higher than ($Ac_1$ Transformation Point×0.2+$Ac_3$ Transformation Point×0.8), and then Starting the Forming]

To cause the partial transformation, while annealing, of martensite or bainite, which is contained in the thin steel sheet, the heating temperature should be controlled in a prescribed range. The proper control of the heating temperature makes it possible to cause transformation into retained austenite or martensite in the subsequent cooling step to provide the final hot press-formed product with a desired structure. When the heating temperature of the thin steel sheet is lower than $Ac_1$ transformation point, a sufficient fraction of austenite cannot be obtained during heating, and therefore, a prescribed fraction of retained austenite cannot be secured in the final structure (the structure of a formed product). When the heating temperature of the thin steel sheet is higher than ($Ac_1$ transformation point×0.2+$Ac_3$ transformation point×0.8), the fraction of transformed austenite is increased too highly during heating, and therefore, a prescribed fraction of annealed martensite or annealed bainite cannot be secured in the final structure (the structure of a formed product).

[During Forming, an Average Cooling Rate of 20° C./Sec or Higher is Kept in the Press Tool]

To change the austenite, which was formed in the above heating step, into a desired structure, while preventing the formation of structures such as ferrite, pearlite, and bainite, the average cooling rate during forming should properly be controlled. From this viewpoint, the average cooling rate during forming should be controlled to 20° C./sec or higher, and may preferably be controlled to 30° C./sec or higher (more preferably 40° C./sec or higher). The control of the average cooling rate during forming can be achieved by a means of, for example, (a) controlling the temperature of a press tool (using a cooling medium shown in FIG. 1 above) or (b) controlling the thermal conductivity of a press tool.

In the hot press-forming method of the present invention, the forming finishing temperature is not particularly limited. The forming may be finished, while cooling to room temperature at a cooling temperature as described above. Alternatively, the cooling is stopped after the cooling to 400° C. or lower (preferably 300° C. or lower, and more preferably 200° C. or lower) and then the forming may be finished.

The hot press-forming method of the present invention can be applied, not only to the case where a hot press-formed product having a simple shape as shown in FIG. 1 above is produced (i.e., direct method), but also to the case where a formed product having a relatively complicated shape is produced. However, in the case of a complicated product shape, it may be difficult to provide a product with the final shape by a single press forming step. In such a case, there can be used a method of cold press forming in a step prior to hot press forming (this method has been referred to as "indirect method"). This method includes previously forming a difficult-to-form portion into an approximate shape by cold processing and then hot press forming the other portions. When such a method is used to produce, for example, a formed product having three projections (profile peaks) by forming, two projections are formed by cold press forming and the third projection is then formed by hot press forming.

The present invention is intended for a hot press-formed product made of a high-strength steel sheet, the steel grade of which is acceptable, if it has an ordinary chemical element composition as a high-strength steel sheet, in which, however, C, Si, Mn, P, S, Al, and N contents may preferably be controlled in their respective proper ranges. From this viewpoint, the preferred ranges of these chemical elements and the grounds for limiting their ranges are as follows:

[C at 0.1% to 0.3%]

C is an important element for securing retained austenite. The concentration of austenite during heating at a temperature within two-phase region allows the formation of retained austenite after quenching. It further contributes to an increase of martensite fraction. When C content is lower than 0.1%, a prescribed fraction of retained austenite cannot be secured, making it impossible to obtain excellent ductility. When C content becomes higher than 0.3%, it results in that strength becomes too high. C content may more preferably be not lower than 0.15% as the more preferred lower limit (still more preferably not lower than 0.20%) and not higher than 0.27% as the more preferred upper limit (still more preferably not higher than 0.25%).

[Si at 0.5% to 3%]

Si prevents austenite after heating at a temperature within two-phase region from being decomposed into cementite and ferrite, and exhibits the action of increasing the fraction of retained austenite. It further exhibits the action of enhancing strength by solid solution enhancement without deteriorating ductility too much. When Si content is lower than 0.5%, retained austenite cannot be secured at a prescribed fraction, making it impossible to obtain excellent ductility. When Si content becomes higher than 3%, the degree of solid solution enhancement becomes too high, resulting in the drastic deterioration of ductility. Si content may more preferably be not lower than 1.15% as the more preferred lower limit (still more preferably not lower than 1.20%) and not higher than 2.7% as the more preferred upper limit (still more preferably not higher than 2.5%).

[Mn at 0.5% to 2%]

Mn is an element to stabilize austenite, and it contributes to an increase of retained austenite. It suppresses ferrite transformation, pearlite transformation, and bainite transformation, and therefore, it is an element to prevent the formation of ferrite, pearlite, and bainite, during cooling after heating, thereby contributing to the securement of retained austenite. To make such an effect exhibited, Mn may preferably be contained at 0.5% or higher. Mn content may be preferred when it is higher, in the case where only characteristics are taken into consideration, but Mn content may preferably be controlled to 2% or lower, because of a cost increase by alloy element addition. In addition, a considerable improvement of austenite strength increases a hot rolling load, thereby making it difficult to produce steel sheets, and therefore, even from the viewpoint of productivity, it is not preferable that Mn is contained at higher than 2%. Mn content may more preferably be not lower than 0.7% as the more preferred lower limit (still more preferably not lower than 0.9%) and not higher than 1.8% as the more preferred higher limit (still more preferably not higher than 1.6%).

[P at 0.05% or Lower (not Including 0%)]

P is an element unavoidably contained in steel and deteriorates ductility. Therefore, P content may preferably be reduced as low as possible. However, extreme reduction causes an increase of steel production cost, and reduction to 0% is difficult in the actual production. Therefore, P content may more preferably be controlled to 0.05% or lower (not including 0%). P content may more preferably be not higher than 0.045% as the more preferred upper limit (still more preferably not higher than 0.040%).

[S at 0.05% or Lower (not Including 0%)]

S is also an element unavoidably contained in steel and deteriorates ductility, similarly to P. Therefore, S content may preferably be reduced as low as possible. However, extreme reduction causes an increase of steel production cost, and reduction to 0% is difficult in the actual production. Therefore, S content may preferably be controlled to 0.05% or lower (not including 0%). S content may more preferably be not higher than 0.045% as the more preferred upper limit (still more preferably not higher than 0.040%).

[Al at 0.01% to 0.1%]

Al is useful as a deoxidizing element and further useful for fixation of dissolved N in steel as AlN to improve ductility. To make such an effect effectively exhibited, Al content may preferably be controlled to 0.01% or higher. However, when Al content becomes higher than 0.1%, it results in the excessive formation of $Al_2O_3$ to deteriorate ductility. Al content may more preferably be not lower than 0.013% as the more preferred lower limit (still more preferably not lower than 0.015%) and not higher than 0.08% as the more preferred upper limit (still more preferably not higher than 0.06%).

[N at 0.001% to 0.01%]

N is an element unavoidably incorporated in steel, and a reduction of N content may be preferred, which has, however, a limitation in actual process. Therefore, the lower limit of N content was set to 0.001%. When N content becomes excessive, ductility is deteriorated by strain aging, or the addition of B causes deposition of N as BN, thereby lowering the effect of improving hardenability by solid solution of B. Therefore, the upper limit of N content was set to 0.01%. N content may more preferably be not higher than 0.008% as the more preferred upper limit (still more preferably not higher than 0.006%).

The basic chemical components in the press-formed product of the present invention are as described above, and the remainder consists essentially of iron. The wording "consists essentially of iron" means that the press-formed product of the present invention can contain, in addition to iron, minor components (e.g., besides Mg, Ca, Sr, and Ba, REM such as La, and carbide-forming elements such as Zr, Hf, Ta, W, and Mo) in such a level that these minor components do not inhibit the characteristics of the steel sheet of the present invention, and can further contain unavoidable impurities (e.g., O, H) other than P and S.

It is also useful to allow the press-formed product of the present invention to contain additional elements, when needed; for example, (a) B at 0.01% or lower (not including 0%) and Ti at 0.1% or lower (not including 0%); (b) one or more selected from the group consisting of Cu, Ni, Cr, and Mo at 1% or lower (not including 0%) in total; and (c) V and/or Nb at 0.1% or lower (not including 0%) in total. The press-formed product may have further improved characteristics depending on the kinds of elements contained. When these elements are contained, their preferred ranges and grounds for limitation of their ranges are as follows:

[B at 0.01% or Lower (not Including 0%) and Ti at 0.1% or Lower (not Including 0%)]

B has the action of suppressing ferrite transformation, pearlite transformation, and bainite transformation, and therefore, it is an element to prevent the formation of ferrite, pearlite, and bainite, during cooling after heating, thereby contributing to the securement of retained austenite. To make such an effect exhibited, B may preferably be contained at 0.0001% or higher, but even if B is contained beyond 0.01%, the effect is saturated. B content may more preferably be not lower than 0.0002% as the more preferred lower limit (still more preferably not lower than 0.0005%) and not higher than 0.008% as the more preferred upper limit (still more preferably not higher than 0.005%).

On the other hand, Ti fixes N and maintains B in solid solution state, thereby exhibiting the effect of improving hardenability. To make such an effect exhibited, Ti may preferably be contained at least 4 times higher than N content. However, when Ti content becomes excessive beyond 0.1%, it results in excessive formation of TiC, thereby causing an increase of strength by precipitation enhancement but a deterioration of ductility. Ti content may more preferably be not lower than 0.05% as the more preferred lower limit (still more preferably not lower than 0.06%) and not higher than 0.09% as the more preferred higher limit (still more preferably not higher than 0.08%).

[One or More Selected from the Group Consisting of Cu, Ni, Cr, and Mo at 1% or Lower (not Including 0%) in Total]

Cu, Ni, Cr, and Mo suppress ferrite transformation, pearlite transformation, and bainite transformation, and therefore, prevent the formation of ferrite, pearlite, and bainite, during cooling after heating, and effectively act the securement of retained austenite. To make such an effect exhibited, these elements may preferably be contained at 0.01% or higher in total. Taking only characteristics into consideration, their content may be preferable when it is higher, but may preferably be controlled to 1% or lower in total because of a cost increase by alloy element addition. In addition, these elements have the action of considerably enhancing the strength of austenite, thereby increasing a hot rolling load so that the production of steel sheets becomes difficult. Therefore, even from the viewpoint of productivity, their content may preferably be controlled to 1% or lower. These elements' content may more preferably be not lower than 0.05% as the more preferred lower limit (still more preferably not lower than 0.06%) in total and not higher than 0.09% as the more preferred upper limit (still more preferably not higher than 0.08%) in total.

[V and/or Nb at 0.1% or Lower (not Including 0%) in Total]

V and Nb have the effect of forming fine carbide and make structure fine by pinning effect. To make such an effect exhibited, these elements may preferably be contained at 0.001% or higher in total. However, when these elements' content becomes excessive, it results in the formation of coarse carbide, which becomes the origin of fracture, thereby deteriorating ductility in contrast. Therefore, these elements' content may preferably be controlled to 0.1% or lower in total. These elements' content may more preferably be not lower than 0.005% as the more preferred lower limit (still more preferably not lower than 0.008%) in total and not higher than 0.08% as the more preferred upper limit (still more preferably not higher than 0.06%) in total.

The thin steel sheet for hot press forming of the present invention may be either a non-plated steel sheet or a plated steel sheet. When it is a plated steel sheet, the type of plating may be either ordinary galvanization or aluminium coating. The method of plating may be either hot-dip plating or electroplating. After the plating, alloying heat treatment may be carried out, or additional plating may be carried out as multilayer plating.

According to the present invention, the characteristics of formed products, such as strength and elongation, can be controlled by properly adjusting press forming conditions (heating temperature and cooling rate), and in addition, hot press-formed products having high ductility (retained ductility) can be obtained, so that they can be applied even to parts (e.g., energy-absorbing members), to which conventional hot press-formed products have hardly been applied; therefore, the present invention is extremely useful for extending the application range of hot press-formed products. The formed products, which can be obtained in the present invention, have further enhanced residual ductility as compared with formed products, of which structure was adjusted by ordinary annealing after cold press forming.

The following will describe the advantageous effects of the present invention more specifically by way of Examples, but the present invention is not limited to the Examples described below. The present invention can be put into practice after appropriate modifications or variations within a range capable of meeting the gist described above and below, all of which are included in the technical scope of the present invention.

The present application claims the benefit of priority based on Japanese Patent Application No. 2011-102408 filed on Apr. 28, 2011. The entire contents of the specification of Japanese Patent Application No. 2011-102408 filed on Apr. 28, 2011 are hereby incorporated by reference into the present application.

EXAMPLES

Steel materials having respective chemical element compositions shown in Table 1 below were formed into slabs for experimental use by a vacuum fusion method, after which the slabs were hot rolled, followed by cooling, and then wound. These rolled sheets were further cold rolled into thin steel sheets, followed by quench treatment so that they had respectively prescribed initial structures. In Table 1, $Ac_1$ transformation point and $Ac_3$ transformation point were determined respectively using formulas (1) and (2) described below (see, e.g., the Japanese translation of "The Physical Metallurgy of Steels" originally written by William C. Leslie, published by Maruzen, 1985). Table 1 further shows the calculated values of ($Ac_1$ transformation point×0.2+$Ac_3$ transformation point×0.8) (these calculated values may hereinafter be referred to as "A values").

$$Ac_1 \text{ transformation point (° C.)} = 723 + 29.1\times[Si] - 10.7\times[Mn] + 16.9\times[Cr] - 16.9\times[Ni] \quad (1)$$

$$Ac_3 \text{ transformation point (° C.)} = 910 - 203\times[C]^{1/2} + 44.7\times[Si] - 30\times[Mn] + 700\times[P] + 400\times[Al] + 400\times[Ti] + 104\times[V] - 11\times[Cr] + 31.5\times[Mo] - 20\times[Cu] - 15.2\times[Ni] \quad (2)$$

where [C], [Si], [Mn], [P], [Al], [Ti], [V], [Cr], [Mo], [Cu], and [Ni] indicate C, Si, Mn, P, Al, Ti, V, Cr, Mo, Cu, and Ni contents (% by mass), respectively. When some element indicated in a certain term of formula (1) or (2) above is not contained, calculation is carried out under the assumption that the term does not exist in the formula.

treatment had a size of 190 mm×80 mm (and a sheet thickness of 1.4 mm). Plated steel sheets (Test Nos. 22 and 23) were prepared as follows: The above steel sheet before the heating and cooling treatment was subjected to heat treatment to have a prescribed initial structure using a plating simulator, followed by hot-dip galvanization to obtain a hot-dip galvanized steel sheet (GI) of Test No. 22, or followed by hot-dip galvanization and subsequent alloying treatment to obtain an alloyed hot-dip galvanized steel sheet (GA) of Test No. 23.

For the respective steel sheets after the above treatments (heating and cooling), measurement of tensile strength (TS) and elongation (total elongation EL), and observation of metallic structure (fraction of each structure), were carried out by the methods described below.

[Tensile Strength (TS) and Elongation (Total Elongation EL)]

JIS No. 5 specimens were used for tensile tests to measure tensile strength (TS) and elongation (EL). At that time, strain rate in the tensile tests was set to 10 mm/sec. In the present invention, the specimens were evaluated as "passing" when fulfilling any of the conditions that: (a) tensile strength (TS) is from 780 to 979 MPa and elongation (EL) is 25% or higher; (b) tensile strength (TS) is from 980 to 1179 MPa and elongation (EL) is 20% or higher; and (c) tensile strength (TS) is 1180 MPa or higher and elongation (EL) is 15% or higher.

TABLE 1

| Steel grade | Chemical element composition* (% by mass) C | Si | Mn | P | S | Cu | Ni | Cr | Mo | V | Nb | Ti |
|---|---|---|---|---|---|---|---|---|---|---|---|---|
| A | 0.232 | 1.19 | 1.41 | 0.014 | 0.0021 | — | — | — | — | — | — | — |
| B | 0.231 | 1.21 | 1.39 | 0.014 | 0.0021 | — | — | 0.21 | — | — | — | — |
| C | 0.222 | 1.20 | 1.29 | 0.014 | 0.0021 | — | — | 0.21 | — | — | — | 0.027 |
| D | 0.225 | 1.31 | 1.33 | 0.014 | 0.0021 | 0.15 | — | — | — | — | — | 0.027 |
| E | 0.234 | 1.10 | 1.52 | 0.014 | 0.0021 | — | 0.22 | — | — | — | — | 0.027 |
| F | 0.229 | 1.04 | 1.41 | 0.014 | 0.0021 | 0.07 | — | 0.18 | — | — | — | 0.027 |
| G | 0.219 | 1.20 | 1.14 | 0.014 | 0.0021 | — | — | 0.15 | 0.03 | — | — | 0.027 |
| H | 0.225 | 1.23 | 1.26 | 0.014 | 0.0021 | — | — | — | 0.17 | — | — | 0.027 |
| I | 0.217 | 1.41 | 1.44 | 0.014 | 0.0021 | — | — | 0.20 | — | 0.03 | — | 0.027 |
| J | 0.230 | 0.89 | 1.37 | 0.014 | 0.0021 | — | — | 0.19 | — | — | 0.03 | 0.027 |
| K | 0.047 | 0.89 | 1.25 | 0.014 | 0.0021 | — | — | 0.19 | — | — | 0.03 | 0.027 |
| L | 0.230 | 0.21 | 1.22 | 0.014 | 0.0021 | — | — | 0.19 | — | — | 0.03 | 0.027 |

| Steel grade | Chemical element composition* (% by mass) B | Al | N | $Ac_1$ transformation point | $Ac_3$ transformation point | A value |
|---|---|---|---|---|---|---|
| A | — | 0.053 | 0.0047 | 743 | 854 | 832 |
| B | — | 0.053 | 0.0047 | 747 | 854 | 832 |
| C | 0.0033 | 0.053 | 0.0047 | 748 | 869 | 845 |
| D | 0.0033 | 0.053 | 0.0047 | 747 | 871 | 846 |
| E | 0.0033 | 0.053 | 0.0047 | 739 | 854 | 831 |
| F | 0.0033 | 0.053 | 0.0047 | 741 | 855 | 833 |
| G | 0.0033 | 0.053 | 0.0047 | 748 | 876 | 850 |
| H | 0.0033 | 0.053 | 0.0047 | 742 | 878 | 851 |
| I | 0.0033 | 0.053 | 0.0047 | 752 | 875 | 850 |
| J | 0.0033 | 0.053 | 0.0047 | 737 | 851 | 828 |
| K | 0.0033 | 0.053 | 0.0047 | 739 | 908 | 874 |
| L | 0.0033 | 0.053 | 0.0047 | 719 | 825 | 804 |

*The remainder consists of iron and unavoidable impurities other than P, S, and N.

The steel sheets thus obtained were heated under the respective conditions shown in Table 2 below, and then subjected to cooling treatment using a high speed heat treatment testing system for steel sheets (CAS series, available from ULVAC-RIKO, Inc.), which can control an average cooling rate. The steel sheets to be subjected to cooling

[Observation of Metallic Structure (Fraction of Each Structure)]

(1) For annealed martensite, bainite, and annealed bainite structures in the steel sheets, the steel sheets were each subjected to nital etching, and then observed by SEM (with a magnification of 1000× or 2000×), in which annealed martensite, bainite, and annealed bainite were distinguished to determine their respective fractions (volume fractions).

(2) For the fraction of retained austenite in the steel sheets, the steel sheets were each measured by an X-ray diffraction method, after grinding to one-quarter thicknesses of the steel sheets and subsequent chemical polishing (see, e.g., ISJJ Int. Vol. 33 (1933), No. 7, p. 776).

(3) For the fraction of as-quenched martensite, the steel sheets were each subjected to repera etching, and assuming white contrast as a mixed structure of as-quenched martensite and retained austenite, the volume fraction of the mixed structure was measured. The fraction of as-quenched martensite was calculated by subtracting the fraction of retained austenite, which had been determined by an X-ray diffraction method, from the volume fraction of the mixed structure.

These results are shown in Table 2 below, together with pre-forming steel sheet structure (initial structure) and production conditions (heating temperature and average cooling rate).

TABLE 2

| | | Production conditions | | | | | Formed product structure (% by volume) | |
|---|---|---|---|---|---|---|---|---|
| | | Initial structure (% by volume) | | | Heating | Average | | |
| Test No. | Steel grade | Martensite | Bainite | Surface Plating | temperature (° C.) | cooling rate (° C./sec) | Annealed martensite | Annealed bainite |
| 1 | A | 100 | — | none | 930 | 40 | 0 | 0 |
| 2 | A | 100 | — | none | 825 | 40 | 44 | 0 |
| 3 | A | 100 | — | none | 800 | 40 | 60 | 0 |
| 4 | A | 100 | — | none | 775 | 40 | 80 | 0 |
| 5 | A | 100 | — | none | 730 | 40 | 0 | 0 |
| 6 | A | 100 | — | none | 825 | 10 | 40 | 0 |
| 7 | A | — | 100 | none | 825 | 40 | 0 | 48 |
| 8 | B | 100 | — | none | 825 | 40 | 45 | 0 |
| 9 | C | 100 | — | none | 825 | 40 | 45 | 0 |
| 10 | D | 100 | — | none | 800 | 40 | 49 | 0 |
| 11 | E | 100 | — | none | 800 | 40 | 45 | 0 |
| 12 | F | 100 | — | none | 800 | 40 | 47 | 0 |
| 13 | G | 100 | — | none | 800 | 40 | 47 | 0 |
| 14 | H | 100 | — | none | 800 | 40 | 50 | 0 |
| 15 | I | 100 | — | none | 800 | 40 | 50 | 0 |
| 16 | J | 100 | — | none | 800 | 40 | 46 | 0 |
| 17 | K | 100 | — | none | 800 | 40 | 50 | 0 |
| 18 | L | 100 | — | none | 800 | 40 | 45 | 0 |
| 19 | C | 80 | — | none | 800 | 40 | 49 | 0 |
| 20 | C | — | 80 | none | 800 | 40 | 50 | 0 |
| 21 | C | — | 50 | none | 800 | 40 | 14 | 0 |
| 22 | C | — | 92 | GI | 800 | 40 | 47 | 0 |
| 23 | C | — | 92 | GA | 800 | 40 | 49 | 0 |

| | Formed product structure (% by volume) | | | Tensile strength | Elongation |
|---|---|---|---|---|---|
| Test No. | As-quenched martensite | Other structure | Retained austenite | TS (MPa) | EL (%) |
| 1 | 10 | 90 (bainite) | 0 | 1200 | 7 |
| 2 | 35 | 15 (bainite) | 6 | 1020 | 22 |
| 3 | 20 | 12 (bainite) | 8 | 920 | 25 |
| 4 | 10 | 0 | 10 | 850 | 28 |
| 5 | 0 | 100 (tempered martensite) | 0 | 610 | 15 |
| 6 | 9 | 20 (pearlite) 30 (bainite) | 1 | 850 | 10 |
| 7 | 30 | 16 (bainite) | 6 | 1010 | 23 |
| 8 | 38 | 10 (bainite) | 7 | 1180 | 17 |
| 9 | 38 | 10 (bainite) | 7 | 1180 | 16 |
| 10 | 41 | 3 (bainite) | 7 | 1194 | 19.9 |
| 11 | 49 | 0 | 6 | 1198 | 19.5 |
| 12 | 48 | 0 | 5 | 1223 | 16.2 |
| 13 | 37 | 8 (bainite) | 8 | 1245 | 19.6 |
| 14 | 40 | 2 (bainite) | 8 | 1198 | 16.8 |
| 15 | 40 | 4 (bainite) | 6 | 1225 | 16.2 |
| 16 | 37 | 10 (bainite) | 7 | 1221 | 18.2 |
| 17 | 21 | 27 (bainite) | 2 | 922 | 13.4 |
| 18 | 42 | 13 (bainite) | 0 | 1173 | 11.4 |
| 19 | 42 | 2 (bainite) | 7 | 1195 | 17.8 |
| 20 | 38 | 6 (bainite) | 6 | 1184 | 18.4 |
| 21 | 40 | 30 (ferrite) 10 (bainite) | 6 | 1034 | 15.6 |
| 22 | 38 | 9 (bainite) | 6 | 1120 | 20.5 |
| 23 | 39 | 5 (bainite) | 7 | 1102 | 21.1 |

From these results, discussions can be made as follows: Test Nos. 2 to 4, 7 to 16, 19, 20, 22, and 23 are Examples fulfilling the requirements defined in the present invention, thereby indicating that parts having satisfactory balance between strength and ductility were obtained.

In contrast, Test Nos. 1, 5, 6, 17, 18, and 21 are Comparative Examples not fulfilling any of the requirements defined in the present invention, thereby deteriorating any of the characteristics. More specifically, Test No. 1 was the case where heating temperature was higher than A value, so that the formed product had a structure composed mainly of bainite and retained austenite was not secured, thereby obtaining only low elongation EL.

Test No. 5 was the case where heating temperature was lower than $Ac_1$ transformation point, so that the formed product had a structure composed of tempered martensite at 100% by volume and retained austenite was not secured, thereby obtaining only low tensile strength and low elongation EL. Test No. 6 was the case where average cooling rate during forming was low, so that retained austenite was not secured, thereby obtaining only low elongation EL.

Test No. 17 was the case where C content was lower than that defined in the present invention (steel grade K) in the chemical compositions of steel sheet and formed product, so that retained austenite was not secured, thereby obtaining only low elongation EL. Test No. 18 was the case where Si content was lower than that defined in the present invention (steel grade L) in the chemical compositions of steel sheet and formed product, so that retained austenite was not secured, thereby obtaining only low elongation EL.

Test No. 21 was the case where the fraction of bainite in the initial structure of the steel sheet was lower than that defined in the present invention, so that the fraction of martensite became low and the fraction of other structures (ferrite and bainite) became high in the structure of the formed product, thereby obtaining only low elongation EL.

INDUSTRIAL APPLICABILITY

The present invention makes it possible to provide a hot press-formed product, including a thin steel sheet formed by a hot press-forming method, and having a metallic structure that contains retained austenite at 3% to 20% by volume, whereby balance between strength and elongation can be controlled in a proper range and high ductility can be achieved.

DESCRIPTION OF REFERENCE NUMERALS

1 Punch
2 Die
3 Blank holder
4 Steel sheet (Blank)

The invention claimed is:

1. A process for producing a hot press-formed product, comprising:

heating a thin steel sheet having a metallic structure that contains martensite or bainite at 80% by volume or higher to a temperature not lower than $Ac_1$ transformation point and not higher than ($Ac_1$ transformation point×0.2+$Ac_3$ transformation point×0.8); and then starting the forming of the thin steel sheet with a press tool to produce the hot press-formed product, during which forming an average cooling rate of 20° C./sec or higher is kept in the press tool, wherein the hot press-formed product having a metallic structure that consisting of retained austenite at 3% to 20% by volume, annealed martensite or annealed bainite at 30% to 97% by volume, as-quenched martensite at 0% to 67% by volume, and the remainder structure at 0% to 20% by volume;

and the hot press-formed product having a chemical element composition consisting of:

C at 0.1% to 0.3% (where "%" means "% by mass", and the same applies to the below with respect to the chemical element composition);

Si at 0.5% to 3%;

Mn at 0.5% to 2%;

P at 0.05% or lower (not including 0%);

S at 0.05% or lower (not including 0%);

Al at 0.01% to 0.1%; and

N at 0.001% to 0.01%, and the remainder consisting of iron and unavoidable impurities.

2. The process for producing the hot press-formed product according to claim 1, further comprising, as additional elements, B at 0.01% or lower (not including 0%) and Ti at 0.1% or lower (not including 0%).

3. The process for producing the hot press-formed product according to claim 1, further comprising, as additional elements, one or more selected from the group consisting of Cu, Ni, Cr, and Mo at 1% or lower (not including 0%) in total.

4. The process for producing the hot press-formed product according to claim 1, further comprising, as additional elements, V and/or Nb at 0.1% or lower (not including 0%) in total.

* * * * *